US009206666B2

(12) United States Patent
Hallundbæk et al.

(10) Patent No.: US 9,206,666 B2
(45) Date of Patent: Dec. 8, 2015

(54) ANNULAR BARRIER WITH EXTERNAL SEAL

(75) Inventors: Jørgen Hallundbæk, Græsted (DK); Paul Hazel, Aberdeen (GB); Tomas Sune Andersen, Helsingør (DK)

(73) Assignee: WELLTEC A/S, Allerød (DK)

( * ) Notice: Subject to any disclaimer, the term of this patent is extended or adjusted under 35 U.S.C. 154(b) by 186 days.

(21) Appl. No.: 14/128,705

(22) PCT Filed: Jun. 22, 2012

(86) PCT No.: PCT/EP2012/062120

§ 371 (c)(1),
(2), (4) Date: Dec. 23, 2013

(87) PCT Pub. No.: WO2012/175695

PCT Pub. Date: Dec. 27, 2012

(65) Prior Publication Data

US 2014/0145402 A1 May 29, 2014

(30) Foreign Application Priority Data

Jun. 23, 2011 (EP) ..... 11171168

(51) Int. Cl.
*E21B 33/12* (2006.01)
*E21B 33/127* (2006.01)
*E21B 43/10* (2006.01)

(52) U.S. Cl.
CPC ..... *E21B 33/127* (2013.01); *E21B 33/12* (2013.01); *E21B 33/1208* (2013.01); *E21B 43/103* (2013.01)

(58) Field of Classification Search
CPC ..... E21B 33/127; E21B 33/1272; E21B 33/1275; E21B 33/1277; E21B 33/1208; E21B 33/12; E21B 43/103
See application file for complete search history.

(56) References Cited

U.S. PATENT DOCUMENTS 3,044,553 A * 7/1962 Bradley ..... E21B 33/127 166/131
3,272,517 A * 9/1966 Howard ..... E21B 33/1208 277/333

(Continued)

FOREIGN PATENT DOCUMENTS

DK EP 2206879 A1 * 7/2010 ..... E21B 33/1208
DK EP 2312119 A1 * 4/2011 ..... E21B 33/1277

OTHER PUBLICATIONS

International Search Report for PCT/EP2012/062120, mailed Aug. 7, 2012.

(Continued)

*Primary Examiner* — Gilbert Lee
(74) *Attorney, Agent, or Firm* — Nixon & Vanderhye P.C.

(57) ABSTRACT

The present invention relates to an annular barrier to be expanded in an annulus between a well tubular structure and an inside wall of a borehole downhole, comprising a tubular part for mounting as part of the well tubular structure, said tubular part having a longitudinal axis, an expandable sleeve surrounding the tubular part and having an outer face, each end of the expandable sleeve being fastened by means of a connection part to the tubular part, and an aperture in the expandable sleeve or the connection part, wherein a first connection and a second connection are fastened on the outer face of the expandable sleeve, and a safety sleeve having an opening is fastened to the expandable sleeve by means of the first and the second connections, the safety sleeve and the expandable sleeve defining a space being in fluid communication with the annulus.

20 Claims, 13 Drawing Sheets

(56) References Cited

U.S. PATENT DOCUMENTS

| | | | | |
|---|---|---|---|---|
| 3,428,124 | A * | 2/1969 | Armstrong | E21B 33/127 166/187 |
| 5,184,677 | A * | 2/1993 | Dobscha | E21B 33/1243 166/183 |
| 5,195,583 | A * | 3/1993 | Toon | E21B 33/1243 166/179 |
| 6,065,544 | A * | 5/2000 | Holbert | E21B 33/127 166/127 |
| 2004/0055758 | A1 | 3/2004 | Brezinski et al. | |
| 2005/0098324 | A1 | 5/2005 | Gano | |
| 2005/0161232 | A1 | 7/2005 | Patel et al. | |
| 2006/0027371 | A1 | 2/2006 | Gorrara | |
| 2007/0056749 | A1 | 3/2007 | Gambier et al. | |
| 2008/0000646 | A1 | 1/2008 | Thomson | |
| 2012/0199339 | A1 * | 8/2012 | Hallundbæk et al. | E21B 33/1277 166/134 |

OTHER PUBLICATIONS

International Preliminary Report on Patentability issued in International Application No. PCT/EP2012/062120 dated Dec. 23, 2013.

* cited by examiner

A-A

ANNULAR BARRIER WITH EXTERNAL SEAL

This application is the U.S. national phase of International Application No. PCT/EP2012/062120 filed 22 Jun. 2012 which designated the U.S. and claims priority to EP Application No. 11171168.5 filed 23 Jun. 2011, the entire contents of each of which are hereby incorporated by reference.

FIELD OF THE INVENTION

The present invention relates to an annular barrier to be expanded in an annulus which comprises well fluid and is arranged between a well tubular structure and an inside wall of a borehole downhole, the annular barrier comprising a tubular part for mounting as part of the well tubular structure, the tubular part having a longitudinal axis, an expandable sleeve surrounding the tubular part and having an outer face, each end of the expandable sleeve being fastened to the tubular part by means of a connection part, an aperture in the tubular part or the connection part.

BACKGROUND ART

Annular barriers are used in wellbores for different purposes, such as for providing a barrier for flowing between an inner and an outer tubular structure or an inner tubular structure and an inner wall of the borehole. The annular barriers are mounted as part of the well tubular structure. An annular barrier has an inner wall surrounded by an annular expandable sleeve. The expandable sleeve is typically made of an elastomeric material, but may also be made of metal. The sleeve is fastened at its ends to the inner wall of the annular barrier.

A second annular barrier is used to seal off a zone between an inner and an outer tubular structure or a well tubular structure and the borehole. The first annular barrier is expanded on one side of the zone to be sealed off, and the second annular barrier is expanded on the other side of that zone. Thus, the entire zone is sealed off.

The pressure envelope of a well is governed by the burst rating of the tubular and the well hardware etc. used within the well construction. In some circumstances, the expandable sleeve of an annular barrier may be expanded by increasing the pressure within the well, which is the most cost-efficient way of expanding the sleeve. The burst rating of a well defines the maximum pressure that can be applied to the well for expansion of the sleeve, and it is desirable to minimise the expansion pressure required for expanding the sleeve to minimise the exposure of the well to the expansion pressure.

When expanded, annular barriers may be subjected to a continuous differential pressure or a periodically high pressure within the annulus. One of the purposes of the barrier is to contain this differential pressure and prevent a leak across the barrier.

The ability of the expanded sleeve of an annular barrier to contain this pressure and seal against the wellbore (or outer pipe) is thus affected by many variables, such as strength of material, wall thickness, surface area exposed to the collapse pressure, temperature, well fluids, etc.

The ability to seal against the differential pressure within the annulus by the expanded sleeve in certain well environments is insufficient for some well applications. Thus, it is desirable to increase the ability to seal against the differential pressure within the annulus to enable use of annular barriers in all wells, specifically in wells that experience a high drawdown pressure during production and depletion. The ability to seal may be improved by increasing the wall thickness or the strength of the material or by changing the type of external elastomers mounted on the expansion sleeve. However, this would increase the expansion pressure, which is not desirable, as already mentioned.

It is thus desirable to provide a solution where the seal capability of the expanded sleeves is increased.

SUMMARY OF THE INVENTION

It is an object of the present invention to wholly or partly overcome the above disadvantages and drawbacks of the prior art. More specifically, it is an object to provide an improved annular barrier with an increased annular seal capability of the expanded sleeve.

The above objects, together with numerous other objects, advantages, and features, which will become evident from the below description, are accomplished by a solution in accordance with the present invention by an annular barrier to be expanded in an annulus which comprises well fluid and is arranged between a well tubular structure and an inside wall of a borehole downhole, the annular barrier comprising

- a tubular part for mounting as part of the well tubular structure, the tubular part having a longitudinal axis,
- an expandable sleeve surrounding the tubular part and having an outer face, each end of the expandable sleeve being fastened to the tubular part by means of a connection part,
- an aperture in the tubular part or the connection part, and
- a safety sleeve having a first connection and a second connection for fastening the safety sleeve on the outer face of the expandable sleeve and an opening in connection with the safety sleeve, the safety sleeve and the expandable sleeve defining a space which is in fluid communication with the annulus though the opening, wherein the safety sleeve has a middle part arranged between the two connections, and the opening is arranged closer to one of the connections than the middle part, enabling fluid communication between the space and the annulus opposite one of the connections through the opening.

In an embodiment of the invention, the annulus which is in fluid communication with the space may extend away from the safety sleeve.

Furthermore, the safety sleeve may have an extension along the longitudinal axis of the tubular part which is less than 30% of an extension of the expandable sleeve along the longitudinal axis of the tubular part, preferably less than 20% of the extension of the expandable sleeve, more preferably less than 10% of the extension of the expandable sleeve.

Moreover, the safety sleeve may have an axial length along the longitudinal axis of the tubular part which is less than 50% of a length of the expandable sleeve along the longitudinal axis of the tubular part, the axial length along the longitudinal axis of the tubular part being less than 30% of the length of the expandable sleeve, preferably less than 20% of the length of the expandable sleeve and more preferably less than 15% of the length of the expandable sleeve along the longitudinal axis of the tubular part.

Additionally, the annular barrier may comprise a plurality of safety sleeves.

In an embodiment, the safety sleeve may comprise a sleeve part fastened to the expandable sleeve by means of at least one of the second connections and may have a thickness which is less than a thickness of the expandable sleeve.

The safety sleeve may be shaped as a ring and be fastened to each connection along its entire circumference.

The safety sleeve may be made of metal or polymers, such as an elastomeric material, silicone, or natural or syntactic rubber.

Also, the safety sleeve may be made of a material having a lower E-modulus than that of the expandable sleeve.

Additionally, a sealing element may be arranged on an outer face of the safety sleeve.

Further, the safety sleeve may comprise a recess.

Moreover, a sealing element may be arranged in the recess.

In one embodiment, the opening may be arranged between one of the connections and the recess.

Moreover, the opening may arranged between one of the connections and the expandable sleeve.

Also, the opening may be provided as a groove in the one of the connections along the longitudinal axis of the tubular part.

Furthermore, the safety sleeve may comprise a sleeve part fastened to the expandable sleeve by means of at least one of the connections, and the opening may be arranged between one of the connections and the sleeve part.

In addition, the safety sleeve may comprise a sleeve part fastened to the expandable sleeve by means of at least one of the connections and a sheet arranged between the sleeve part and the expandable sleeve and at least partly surrounding the expandable sleeve.

In an embodiment, the sheet may extend further along the expandable sleeve between one of the connections and the expandable sleeve.

Moreover, the sheet may partly surround the expandable sleeve, providing a channel being the opening between the connection and the expandable sleeve.

Also, the safety sleeve may be connected to the expandable sleeve at a distance from the recess.

In addition, a distance piece may be arranged in the space at the opening of the safety sleeve.

Furthermore, a one-way valve may be arranged in the opening.

In an embodiment, the recess, in a cross-section along the longitudinal axis of the tubular part, may have a square shape, a triangular shape or a trapezoidal shape.

Also, the sealing element may have a cross-sectional shape corresponding to the cross-sectional shape of the recess.

The sealing element may, in a cross-section along the longitudinal axis of the tubular part, have a square shape, a triangular shape or a trapezoidal shape.

Moreover, the first and second connections may be connection rings.

In one embodiment, the connection rings may be welded, glued, bolted or riveted to the outer face of the expandable sleeve.

Additionally, the annular barrier may comprise a plurality of connection rings and a plurality of safety sleeves arranged between the connection rings.

Further, the annular barrier may have a first end and a second end, and the opening in a first safety sleeve positioned closest to the first end may be arranged closer to the first end than the second end in relation to a middle part of the first safety sleeve, and the opening in a second safety sleeve positioned closest to the second end may be arranged closer to the second end than the first end in relation to a middle part of the second safety sleeve.

Furthermore, the connections may comprise projection elements for anchoring the annular barrier along the longitudinal axis.

The annular barrier may further comprise an anchoring section comprising projection elements arranged on the outer face of the expandable sleeve.

Moreover, the projection element may be a spike, barb or similar projection, or a circumferential peaking projection.

Also, the sealing element may extend radially beyond the rings from the expandable sleeve.

The expandable sleeve may be capable of expanding to a diameter which is at least 10% larger, preferably at least 15% larger, more preferably at least 30% larger than that of an unexpanded sleeve.

In one embodiment, the expandable sleeve may have a wall thickness which is thinner than a length of the expandable sleeve, the thickness preferably being less than 25% of its length, more preferably less than 15% of its length, and even more preferably less than 10% of its length.

In another embodiment, the expandable sleeve may have a varying thickness along the periphery and/or length.

Moreover, at least one of the connection parts may be slidable in relation to the tubular part of the annular barrier.

In one embodiment, at least one sealing element, such as an O-ring, may be arranged between the slidable connection part and the tubular part.

Also, at least one of the connection parts may be fixedly fastened to the tubular part.

Further, both of the connection parts may be fixedly fastened to the tubular part.

Additionally, a plurality of the sealing elements may be arranged in one recess.

The safety sleeve may have an extension along the longitudinal axis which is shorter than an extension of the expandable sleeve along the longitudinal axis.

In addition, the extension of the safety sleeve may be less than 30% of the extension of the expandable sleeve, preferably less than 20% of the extension of the expandable sleeve, more preferably less than 10% of the extension of the expandable sleeve.

The present invention further relates to a downhole system comprising a well tubular structure and at least one annular barrier according to the invention.

In one embodiment of the system, a plurality of annular barriers may be positioned at a distance from each other along the well tubular structure.

In another embodiment, the system may further comprise an expansion means which may comprise explosives, pressurised fluid or cement or a combination thereof.

Also, the present invention relates to a seal maintaining method comprising the steps of:

- inserting an annular barrier according to the invention in the borehole having a well pressure,
- expanding the expandable sleeve by injecting pressurised fluid into the aperture, and
- expanding the safety sleeve to force the sealing element into sealing contact with the wall of the borehole when the well pressure becomes higher than a predetermined pressure.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
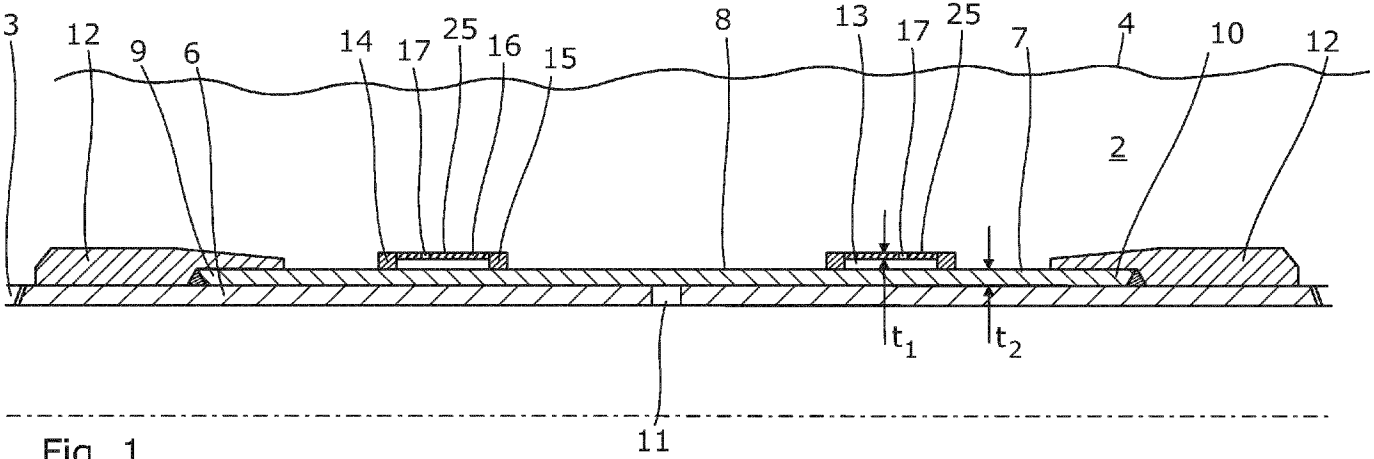
FIG. 1 shows a cross-sectional view of an annular barrier in an unexpanded condition.
Figure 2:
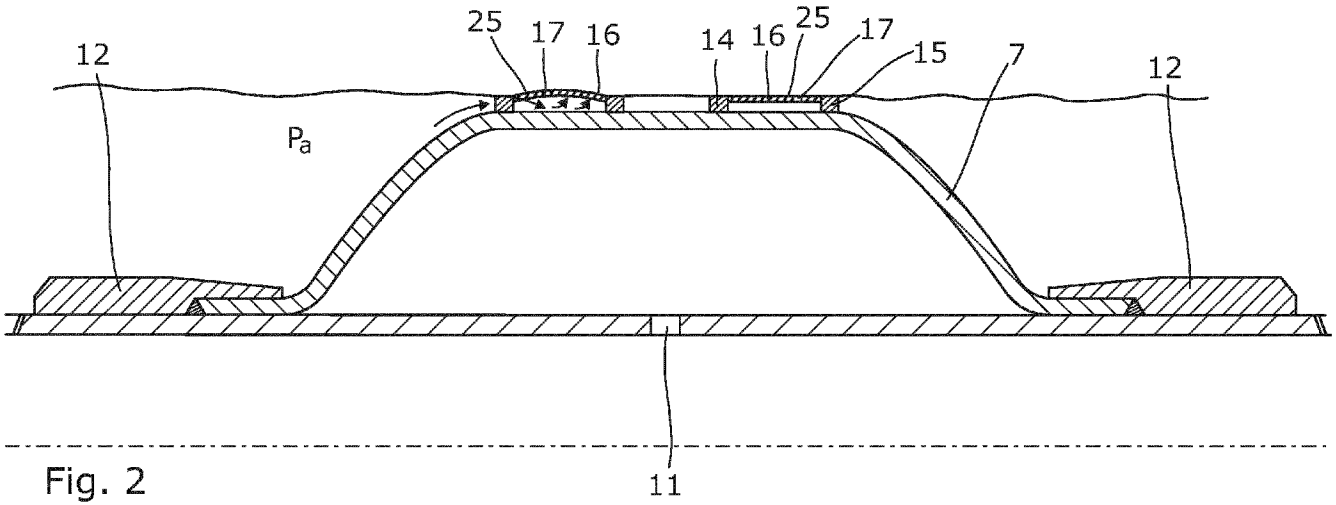
FIG. 2 shows a cross-sectional view of the annular barrier of FIG. 1 in an expanded condition.

FIG. 1 shows an annular barrier 1 to be expanded in an annulus 2 between a well tubular structure 3 and an inside wall 4 of a borehole 5. The annular barrier is expanded, as shown in FIG. 2, to isolate a production zone downhole. The annular barrier is expanded using a pressure of up to 6000 PSI. When the annular barrier has been expanded, it may be exposed to continuous differential pressure or a periodically high pressure within the annulus, and the annular barrier therefore needs to contain this differential pressure and prevent a leak across the barrier.

The annular barrier 1 comprises a tubular part 6 for mounting as part of the well tubular structure 3, the tubular part 6 having a longitudinal axis. The annular barrier 1 is thus assembled as part of the casing string. The annular barrier 1 comprises an expandable sleeve 7 surrounding the tubular part 6 and having an outer face 8, and each end 9, 10 of the expandable sleeve is fastened to the tubular part by means of a connection part 12. The annular barrier has an aperture 11 in the expandable sleeve 7 or the connection part 12 for pressurising the cavity between the expandable sleeve 7 and the tubular part 6 in order to expand the sleeve so that it presses against an inner wall of the borehole 5. A first connection 14 and a second connection 15 of a safety sleeve are fastened on the outer face of the expandable sleeve, and the safety sleeve 16 has an opening 17 and a sleeve part 25 which is thus fastened to the expandable sleeve by means of the first and the second connections. The safety sleeve 16 and the outer face 8 of the expandable sleeve 7 define a space 13 which is in fluid communication with the annulus through the opening 17 opposite one of the connections when the expandable sleeve is expanded, as illustrated with arrows in FIG. 2.

As can be seen in FIG. 2, the formation pressure in the annulus Pa has increased, and fluid is pressed in through the opening 17 and into the space 13 under the sleeve part 25 of the safety sleeve 16, and the sleeve part 25 is thereby expanded so that it presses against the inner wall of the borehole, maintaining the sealing ability of the annular barrier 1. The expandable sleeve 7 is not influenced during expansion of the safety sleeve 16. The sleeve part 25 of the safety sleeve 16 has a thickness t1 which is less than a thickness t2 of the expandable sleeve 7.

The sleeve part 25 of the safety sleeve 16 is ring-shaped and is fastened to each connection along its entire circumference, providing an enclosed space 13 between the safety sleeve 16 and the expandable sleeve 7, thus fluid communication with the space 13 can only happen through the opening 17. The connections 14, 15 are also ring-shaped and fastened to the expandable sleeve by means of welding, press-fitting or similar fastening. The safety sleeve 16 is made of metal having a lower E-modulus than that of the expandable sleeve 7. The sleeve part 25 of the safety sleeve 16 may also be made of polymers, such as an elastomeric material, silicone, or natural or syntactic rubber.

Figure 3A:
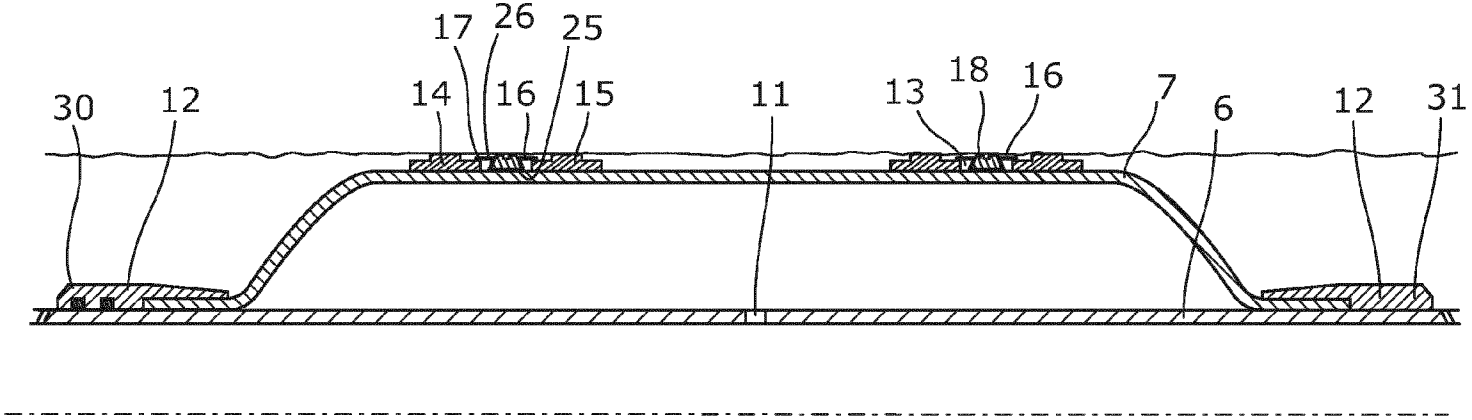
FIG. 3A shows a cross-sectional view of another embodiment of the annular barrier.
Figure 3B:
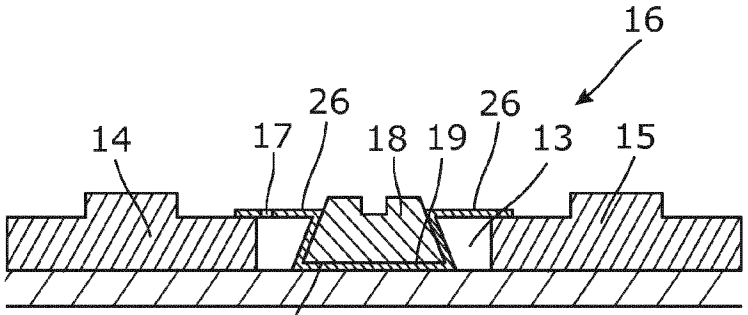
FIG. 3B shows an enlarged view of FIG. 3A.
Figure 4A:
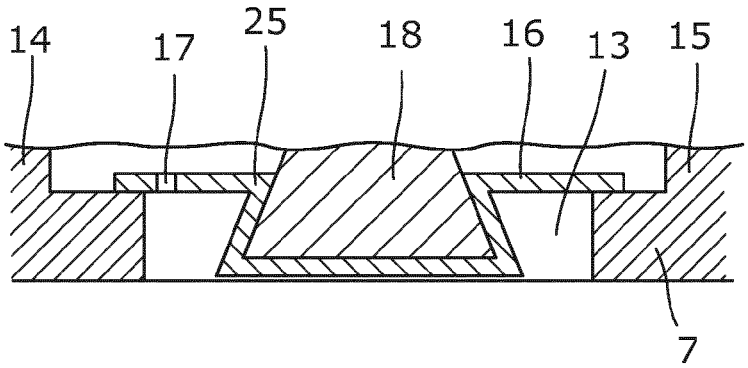
FIG. 4A shows a cross-sectional view of a safety sleeve in its unexpanded condition.
Figure 4B:
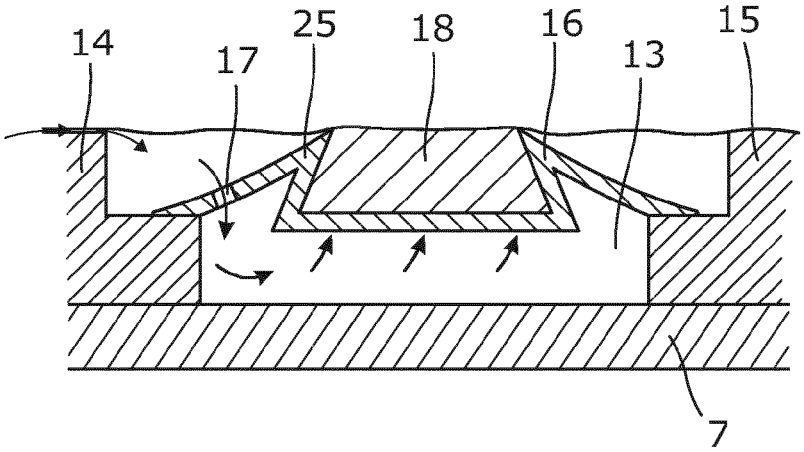
FIG. 4B shows the safety sleeve of FIG. 4A in its expanded condition.

In FIGS. 3A and 3B, a sealing element 18 is arranged on an outer face 19 of the sleeve part 25 of the safety sleeve 16. The safety sleeve 16 has a recess 20 in that the sleeve part 25 has a trapezoidal shape in the cross-sectional view of FIGS. 3B and 4A, and the sealing element 18 is arranged in that recess 20. The sealing element 18 is ring-shaped and has a corresponding cross-sectional trapezoidal shape. When the expandable sleeve 7 is expanded, the sealing elements 18 are pressed towards the borehole 5, and as can be seen in FIG. 4B, fluid is pressed through the opening 17 and into the space 13 at an increased formation pressure Pa, pressing at the safety sleeve 16 and pressing the sealing element 18 towards the borehole 5. In this way, the sealing connection between the annular barrier 1 and the borehole wall is maintained. This is indicated by arrows in FIG. 4B.

As shown in FIG. 3A, the sleeve part 25 of the safety sleeve 16 is fastened to the connections 14, 15 by means of small rings. At its circumference, the sleeve part 25 of the safety sleeve 16 is connected with the connection rings 14, 15 at a distance from the recess, resulting in a distance safety sleeve part 26 on either side of the recess between the recess and the connections. The opening is arranged in one of the distance safety sleeve parts so that when two or more safety sleeves are arranged on one annular barrier, as shown in FIG. 3A, the opening in the safety sleeve 16 closest to one connection part 12 is positioned in the distance safety sleeve part 26 closest to that connection part 12. Furthermore, the opening of the safety sleeve 16 closest to the second connection part 12 is positioned in the distance safety sleeve part 26 closest to that second connection part 12. Thus, the openings are arranged closest to the annulus, and the formation pressure can easily activate the safety sleeve 16 so that the sealing element 18 is forced towards the borehole wall when the formation pressure increases. In FIG. 3A, one connection part is fixedly fastened to the tubular part 6 and another connection part is slidably arranged on the tubular part 6. Two sealing elements, such as O-rings, are arranged between the slidable connection part and the tubular part.

Figure 5:
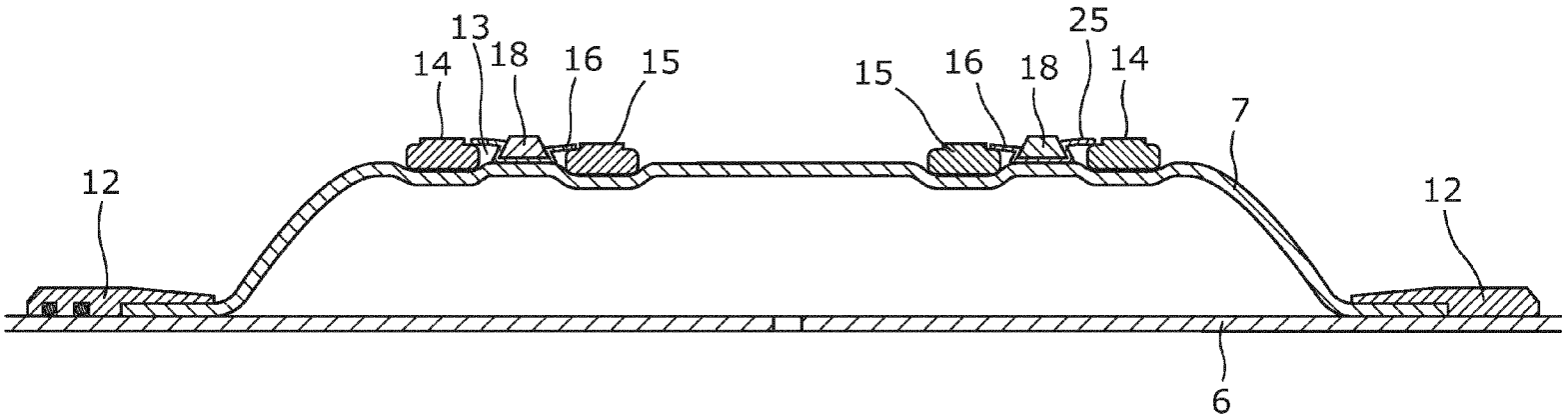
FIG. 5 shows a cross-sectional view of another embodiment of the annular barrier.

In FIG. 5, the connections 14, 15 are larger rings than those shown in FIG. 3A and are capable of restricting the expansion of the expandable sleeve so that the expandable sleeve 7 is prevented from being freely expanded. This results in circumferential grooves being formed in the expandable sleeve, strengthening the expandable sleeve 7 to withstand a higher pressure before collapsing.

Figure 6:
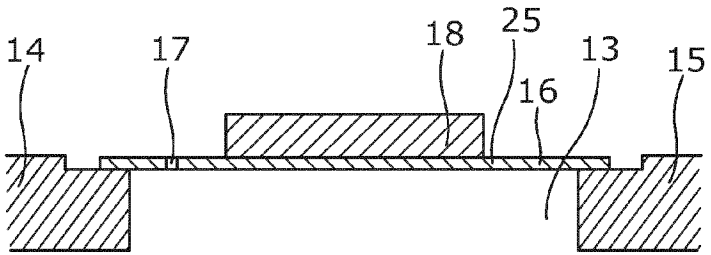
FIGS. 6-11 show cross-sectional views of other embodiments of the safety sleeve in an unexpanded condition.
Figure 7:
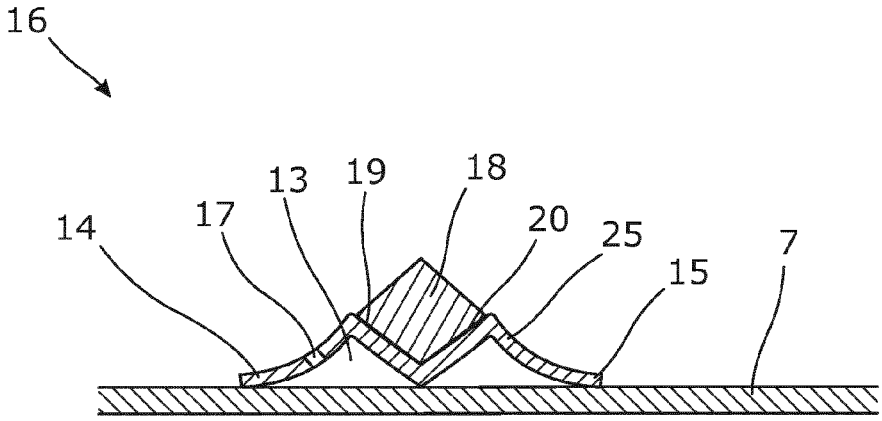

The sleeve part 25 of the safety sleeve 16 is ring-shaped and may have a variety of different cross-sectional shapes, e.g. a regular plate shape without any recesses. The plate-shaped sleeve part 25 of the safety sleeve may have a plate-shaped sealing element, as shown in FIG. 6. In FIG. 7, the safety sleeve 16 is fastened to the expandable sleeve 7 by means of welding connections 14, 15. The safety sleeve 16 has a recess 20, and in cross-section, the sleeve part 25 of the safety sleeve 16 has a triangular or M-shaped cross-section, and a space 13 is present between the safety sleeve 16 and the outer face of the expandable sleeve 7. The safety sleeve 16 has an opening 17 so that the space is in fluid communication with the annulus.

Figure 8:
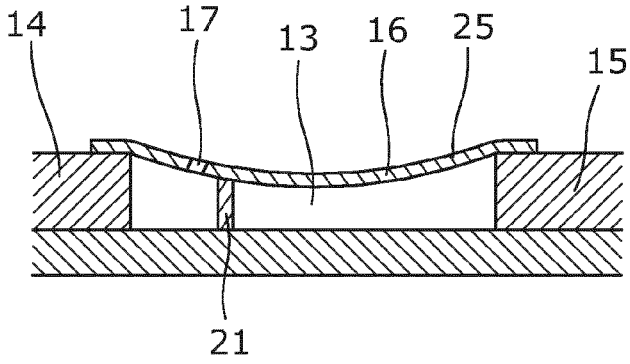

In FIG. 8, the sleeve part 25 of the safety sleeve 16 is fastened at its ends to the connections 14, 15 and has a plate-shaped cross-section, creating a space 13 between the safety sleeve 16 and the expandable sleeve 7. A distance piece 21 is fastened to the sleeve part 25 of the safety sleeve 16 and is arranged in the space at the opening of the sleeve part 25 to ensure that the sleeve part 25 does not collapse while expanding the expandable sleeve 7. The distance piece 21 is arranged opposite the opening to maintain the space at the opening so that well fluid can enter and press the sleeve part 25 of the safety sleeve 16 against the inner wall of the borehole.

Figure 9:
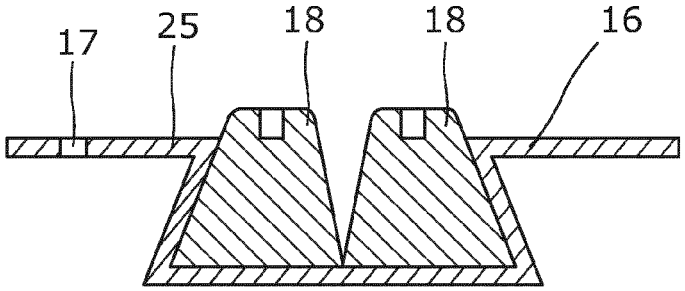
Figure 10:
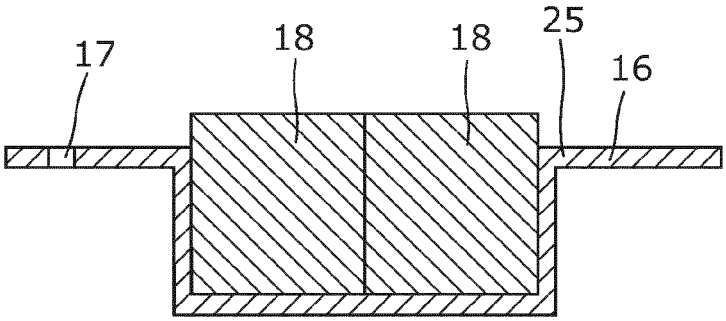
Figure 11:
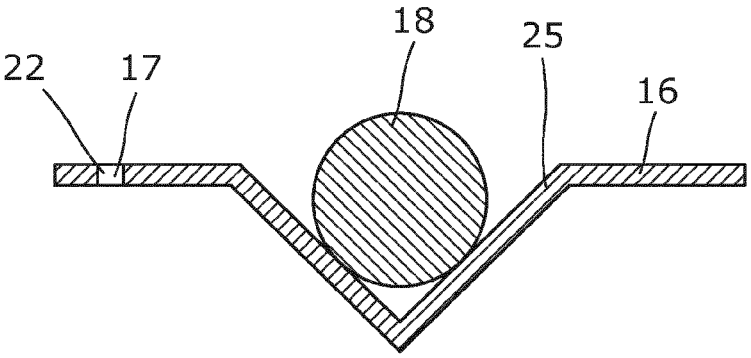

The recess 20 in the sleeve part 25 of the safety sleeve 16 has, in a cross-section along the longitudinal axis of the tubular part, a square shape, a triangular shape or a trapezoidal shape, as shown in FIGS. 9-11. In FIG. 11, the recess is trapezoidal, and two sealing elements 18 arranged in the recess have a corresponding trapezoidal shape. In FIG. 10, the recess has a square shape, and sealing elements 18 arranged therein also have a square cross-section. In FIG. 11, the recess is triangular in cross-section, and one sealing element 18 arranged in the recess has a round cross-section, such as an O-ring. Each of the sleeve parts 25 of the safety sleeves of FIGS. 9-11 has an opening 17 for letting well fluid in and expanding the sleeve part 25 of the safety sleeve 16 so that the sealing elements 18 are pressed towards the wall of the borehole to sealingly engage the wall. As can be seen in FIGS. 9-11, the sealing element extends radially beyond the rings from the expandable sleeve 7 so that when the expandable sleeve is expanded, the sealing elements sealingly engage the wall of the borehole. A one-way valve may be arranged in the opening.

Figure 12:
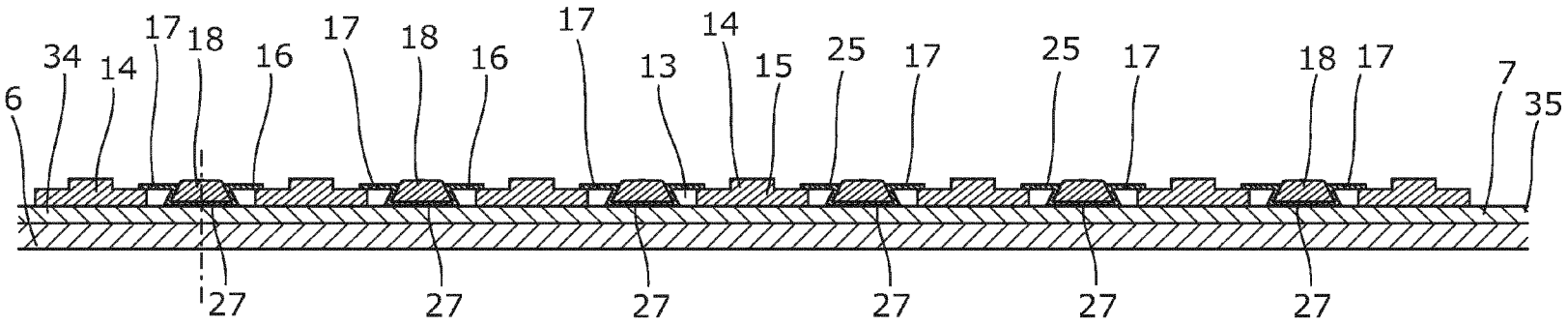
FIG. 12 shows a cross-sectional view of another embodiment of the annular barrier.

The annular barrier 1 may comprise a plurality of safety sleeves 16 being a plurality of connection rings and a plurality of sleeve parts 25 of the safety sleeves arranged between the connection rings, as shown in FIG. 12. Thus, there are a number of connection rings and a number of sleeve parts of the safety sleeves, and the number of connection rings will always exceed the number of sleeve parts by one. The openings in the safety sleeves are arranged so that three openings face a first end 34 of the annular barrier and the other three openings of the safety sleeves face a second end 35 of the annular barrier. Thus, the opening 17 in a first safety sleeve positioned closest to the first end is arranged closer to the first end than the second end in relation to a middle part 27 of the first safety sleeve, and the opening in a second safety sleeve positioned closest to the second end is arranged closer to the second end than the first end in relation to a middle part 27 of the second safety sleeve.

Figure 13:
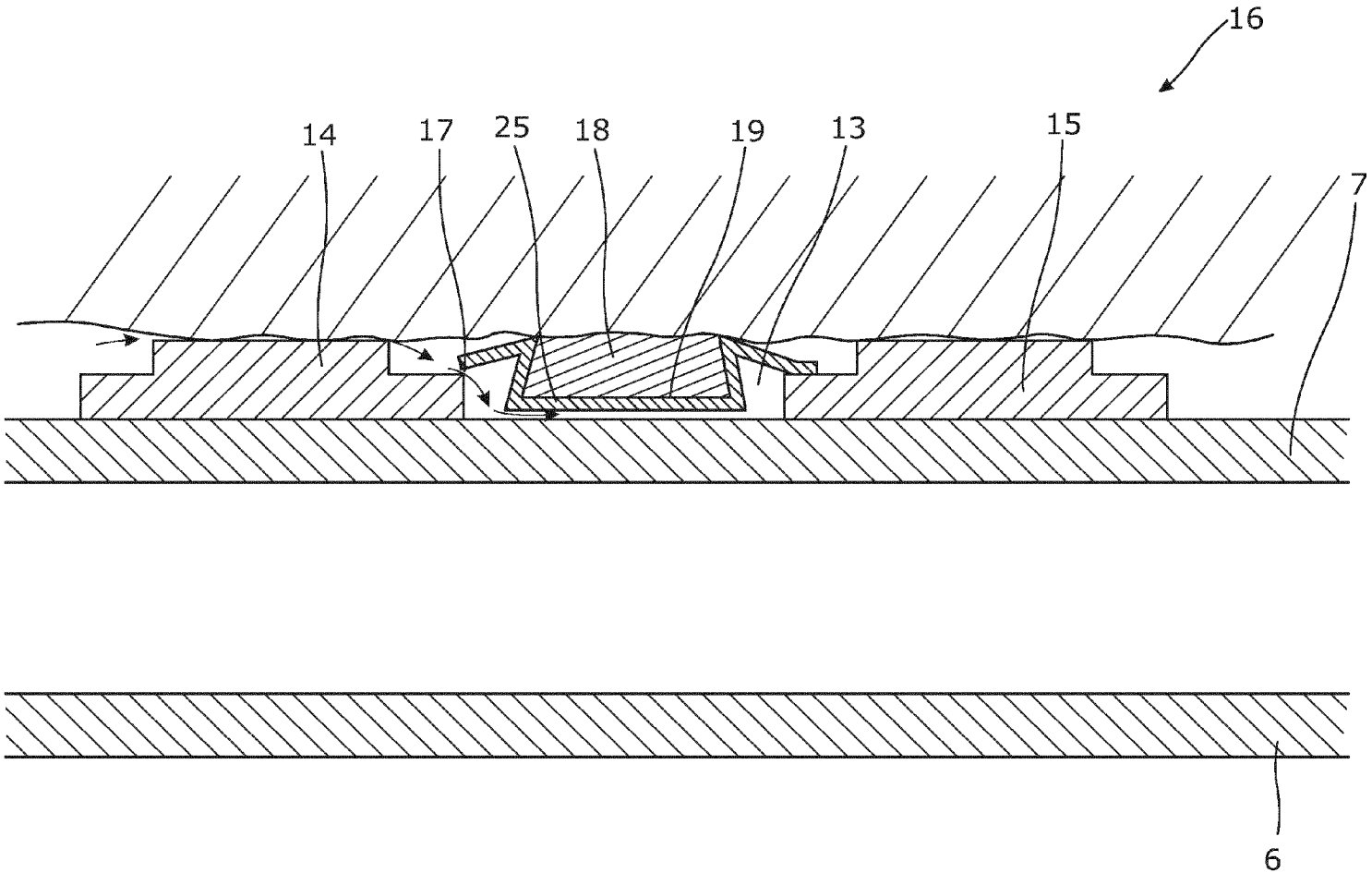
FIG. 13 shows a cross-sectional view of one embodiment of the safety sleeve.

In FIG. 13, the safety sleeve 16 comprises a sleeve part 25 and two connections 14, 15 wherein the second connection 15 connects the sleeve part with the expandable sleeve 7. Thus, the sleeve part 25 is free to move in relation to the first connection, creating an opening 17 so that the fluid can flow between the space and the annulus opposite the first connection 14, as shown. The sleeve part has a recess in which the sealing element is arranged so that when the pressure in the annulus increases, the fluid flows past the connection through the opening 17 between the sleeve part 25 and the first connection 14 and presses the sleeve part and the sealing element against the formation wall.

Figure 14:
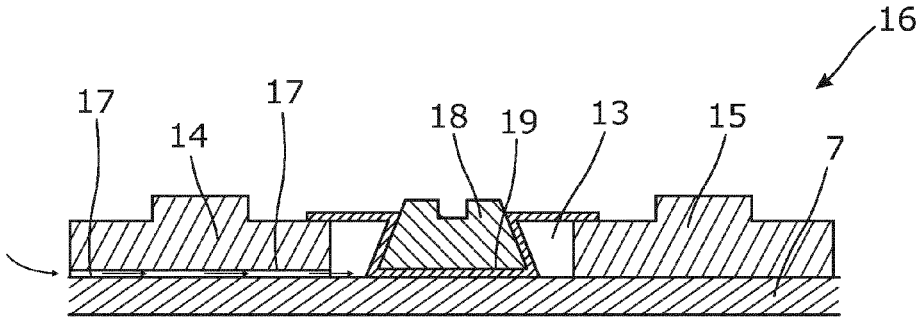
FIG. 14 shows a cross-sectional view of another embodiment of the safety sleeve.

In FIG. 14, the opening is arranged between the first connection and the expandable sleeve 7 so that fluid is allowed to flow underneath the first connection. The opening may be a groove made as a longitudinal groove in the bottom of the first connection along the longitudinal axis of the tubular part.

Figure 15:
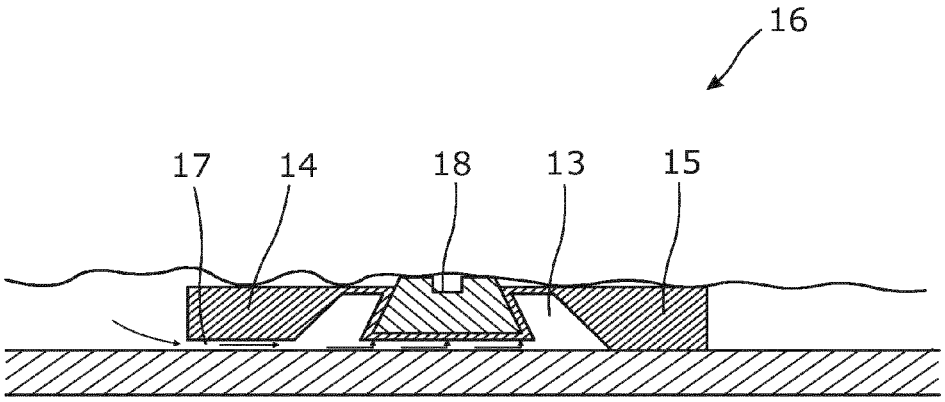
FIG. 15 shows a cross-sectional view of yet another embodiment of the safety sleeve.

The safety sleeve 16 in FIG. 15 is made as one part so that the first and second connections 14, 15 are integral part of the sleeve part 25. The safety sleeve may, in this embodiment, be machined from one metal piece to obtain a trapeze-shape providing a recess in which the sealing element 18 is arranged. The fluid from the annulus surrounding the first connection is allowed to flow into the space 13 in order to press on the safety sleeve and force the sleeve against the formation. Thus, the first connection is not connected or only partly connected with the expandable sleeve, and the second connection 15 is fixedly connection with the expandable sleeve 7.

Figure 16A:
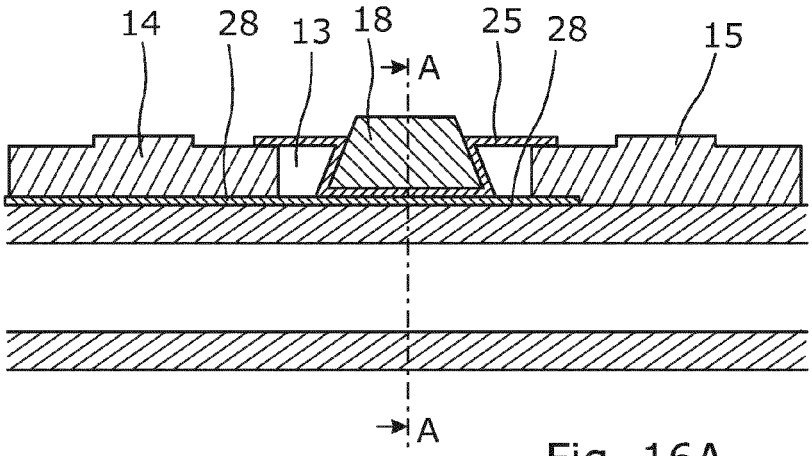
FIG. 16A shows a cross-sectional view of yet another embodiment of the safety sleeve.
Figure 16B:
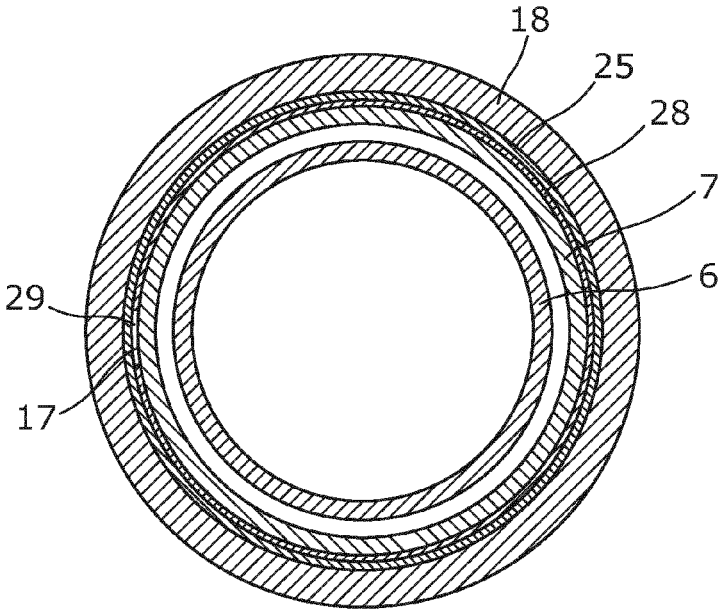
FIG. 16B shows a cross-sectional view along A-A in FIG. 16A.

The safety sleeve of FIG. 16A further comprises a sheet 28 arranged between the sleeve part and the expandable sleeve and at least partly circumferencing the expandable sleeve 7. The sheet extends further along the expandable sleeve between the first connection 14 and the expandable sleeve 7. The sheet is pressed in between the first connection and the expandable sleeve. FIG. 16B shows a cross-section of the un-expanded annular barrier of FIG. 16A. In FIG. 16B, the sheet partly circumferents the expandable sleeve 7, providing a channel 29 being the opening 17 between the connection and the expandable sleeve.

Figure 17:
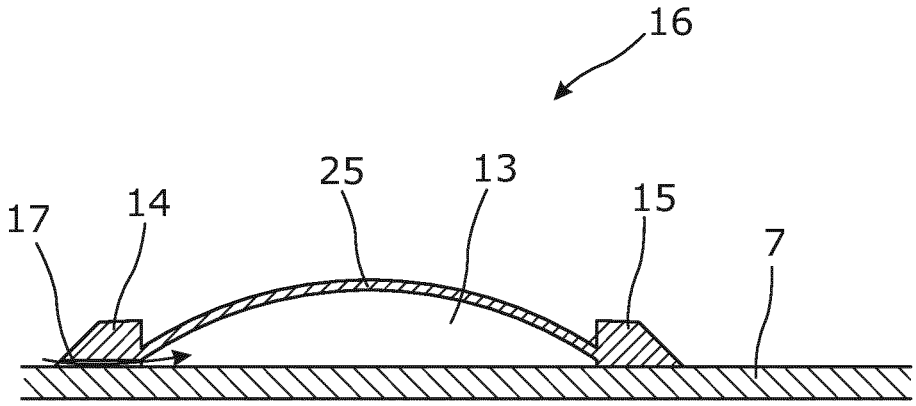
FIG. 17 shows a cross-sectional view of yet another embodiment of the safety sleeve.

The safety sleeve of FIG. 17 is also made in one piece in which the connections and the sleeve part are formed as one part. The second connection 15 fastens the safety sleeve 16 to the outer face of the expandable sleeve 7, and the first connection 14 together with the expandable sleeve encloses the opening, thereby allowing the fluid to flow freely between the space and the annulus opposite the first connection. The sleeve part has a curved shape so that when it is pressed against the formation, an inherent spring force is provided. Then, in case of a back-spring effect of the expandable sleeve, the inherent spring force is released and the sleeve part presses against the formation to seal the annular barrier to the inner surface of the formation. Alternatively, the sleeve part and the two connections may be separate parts where the first and second connections are fastened to the expandable sleeve 7 and the curved sleeve part is arranged between the connections.

The safety sleeve 16 has an extension along the longitudinal axis of the tubular part which is shorter than an extension of the expandable sleeve along the longitudinal axis. The safety sleeves 16 are arranged as a safety precaution in the event that the formation pressure or the differential pressure increases to ensure that the seal towards the borehole wall is maintained. To this effect, the safety sleeves 16 are arranged along the longitudinal axis of the expandable sleeve 7 so that if one sleeve closest to the increased pressure cannot be expanded any further and the fluid passes that safety sleeve 16, the next safety sleeve 16 is expanded to sealingly engage the wall of the borehole, and the seal between the annular barrier and the borehole wall is thereby maintained. The extension of the safety sleeve along the longitudinal axis of the tubular part is less than 30% of the extension of the expandable sleeve along the longitudinal axis of the tubular part, preferably less than 20% of the extension of the expandable sleeve, more preferably less than 10% of the extension of the expandable sleeve.

Figure 18:
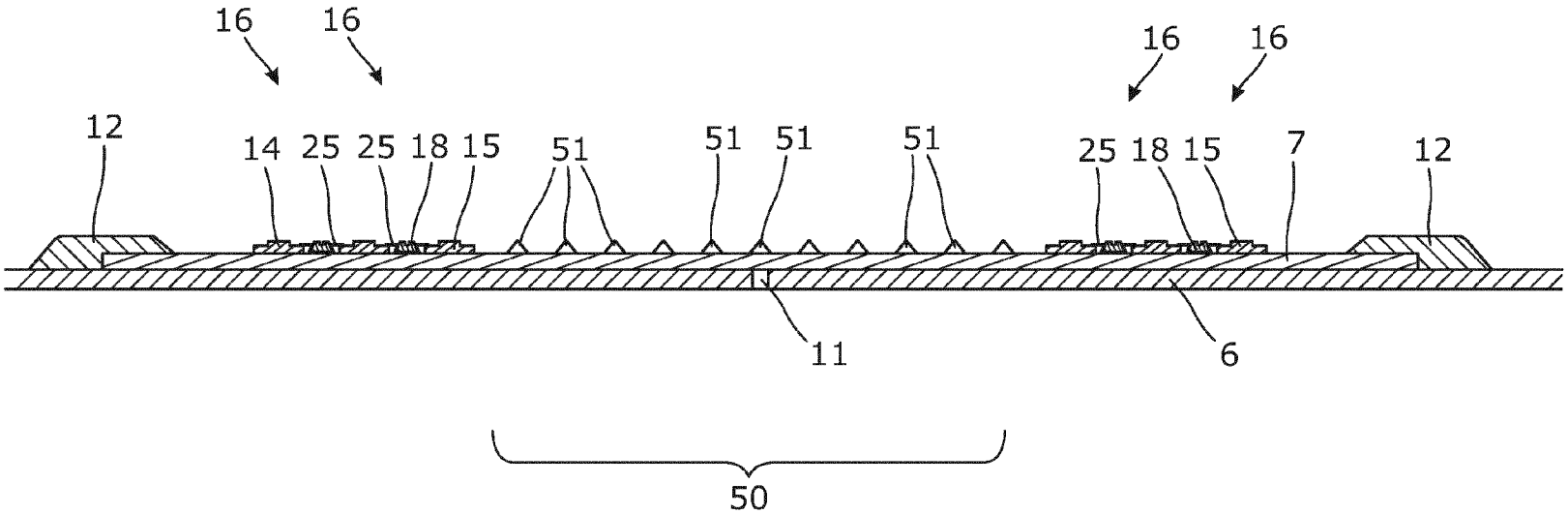
FIG. 18 shows a cross-sectional view of an annular barrier having an anchor section.

In FIG. 18, the annular barrier comprises an anchoring section 50 which is part of the expandable sleeve being provided with projection elements 51, such as spikes or barbs or similar projections. When expanded, the projection elements penetrate the formations and anchor the annular barrier along the longitudinal axis of the annular barrier. The projection elements 51 may also be formed as ring-shaped elements circumferencing the expandable sleeve.

Figure 19:
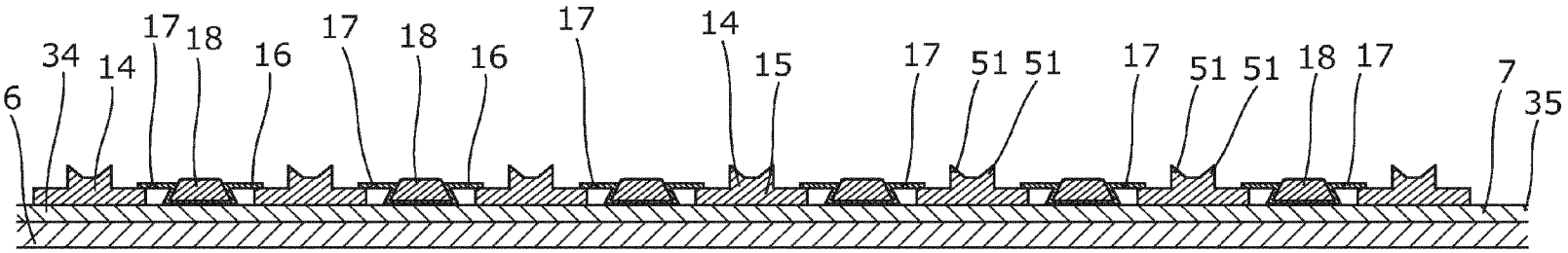
FIG. 19 shows a cross-sectional view of an annular barrier having combined anchors and connection rings.

Additionally, the projection elements 51 are arranged as part of the connections as peaking circumferential projections. The connections are ring-shaped and circumferent the expandable sleeve and end in two peaking points/circumferences when seen in cross-section, as illustrated in FIG. 19.

When the expandable sleeve 7 of the annular barrier 1 is expanded, the diameter of the sleeve is expanded from its initial unexpanded diameter to a larger diameter. The expandable sleeve 7 has an outside diameter D and is capable of expanding to a diameter which is at least 10% larger, preferably at least 15% larger, more preferably at least 30% larger than that of an unexpanded sleeve 7.

Furthermore, the expandable sleeve 7 has a wall thickness t which is thinner than a length of the expandable sleeve, the thickness preferably being less than 25% of the length, more preferably less than 15% of the length, and even more preferably less than 10% of the length.

The expandable sleeve 7 of the annular barrier 1 is made of a first metal having an elongation of 35-70%, at least 40%, preferably 40-50%, and the connection part 12 is made of a second metal having an elongation of 10-35%, preferably 25-35%. The metal of the connection part 12 has an elongation of at least 5 percentage points, preferably at least 10 percentage points higher than the elongation of the metal of the expandable sleeve. The yield strength (soft annealed) of the metal of the expandable sleeve is 200-400 MPa, preferably 200-300 MPa. The yield strength (cold worked) of the metal of the connection part is 500-1000 MPa, preferably 500-700 MPa. Thus, the first metal is more flexible than the second metal.

Both connection parts 12 of the annular barrier may be fixedly fastened to the tubular part, and with maximum diametrical expansion capability, this is considered beneficial since it eliminates any moving parts and obviates the need for expensive and risky high pressure seals within these moving parts. This is particularly important when considering high temperature or corrosive well environments, e.g. Acid, H2S etc.

Having an annular barrier 1 with a slidable connection part 12 between the sleeve 7 and the tubular part 6 results in the expansion ability of the sleeve increasing by up to 100% in relation to an annular barrier without any slidable connection parts.

The annular barrier may be comprised in a downhole system comprising a well tubular structure 3 and a plurality of annular barriers spaced apart along the well tubular structure to isolate a production zone.

The annular barriers may be expanded by pressurising the well tubular structure 3 from within by means of drill pipe or by means of a tool submersible into the well tubular structure and capable of isolating a part of the well tubular structure.

In the event that the tool cannot move forward in the well tubular structure 3, the tool may comprise a downhole tractor, such as a Well Tractor®.

The tool may also use coiled tubing for expanding the expandable sleeve 7 of one annular barrier or two annular barriers 1 at the same time. A tool with coiled tubing can pressurise the fluid in the well tubular structure 3 without having to isolate a section of the well tubular structure. However, the tool may need to plug the well tubular structure further down the borehole for the two annular barriers 1 to be operated.

The safety sleeve is expanded automatically when the formation pressure increases. The expanded safety sleeve is expanded by inserting an annular barrier as part of the well tubular structure in the borehole having a well pressure, and subsequently expanding the expandable sleeve by injecting pressurised fluid into the aperture 11 of the annular barrier. When the formation pressure increases, the safety sleeve is expanded by means of well fluid forcing the sealing element in sealing contact with the wall of the borehole when the well pressure becomes higher than a predetermined pressure.

In one embodiment, the tool comprises a reservoir containing the pressurised fluid, e.g. when the fluid used for expanding the sleeve is cement, gas, or a two-component compound.

An annular barrier 1 may also be called a packer or similar expandable means. The well tubular structure can be the production tubing or casing or a similar kind of tubing downhole in a well or a borehole. The annular barrier 1 can be used both between the inner production tubing and an outer tubing in the borehole or between a tubing and the inner wall of the borehole. A well may have several kinds of tubing, and the annular barrier 1 of the present invention can be mounted for use in all of these.

The valve 19 may be any kind of valve capable of controlling flow, such as a ball valve, butterfly valve, choke valve, check valve or non-return valve, diaphragm valve, expansion valve, gate valve, globe valve, knife valve, needle valve, piston valve, pinch valve or plug valve.

The expandable tubular metal sleeve 7 may be a cold-drawn or hot-drawn tubular structure.

The fluid used for expanding the expandable sleeve 7 may be any kind of well fluid present in the borehole surrounding the tool and/or the well tubular structure 3. Also, the fluid may be cement, gas, water, polymers, or a two-component compound, such as powder or particles mixing or reacting with a binding or hardening agent. Part of the fluid, such as the hardening agent, may be present in the cavity between the tubular part and the expandable sleeve before injecting a subsequent fluid into the cavity.

Although the invention has been described in the above in connection with preferred embodiments of the invention, it will be evident for a person skilled in the art that several modifications are conceivable without departing from the invention as defined by the following claims.

The invention claimed is:

1. An annular barrier (1) to be expanded in an annulus (2) which comprises well fluid and is arranged between a well tubular structure (3) and an inside wall (4) of a borehole (5) downhole, the annular barrier comprising

- a tubular part (6) for mounting as part of the well tubular structure (3), the tubular part having a longitudinal axis,
- an expandable sleeve (7) surrounding the tubular part and having an outer face (8), each end (9, 10) of the expandable sleeve being fastened to the tubular part by means of a connection part (12),
- an aperture (11) in the tubular part or the connection part, and
- a safety sleeve (16) having a first connection (14) and a second connection (15) for fastening the safety sleeve on the outer face of the expandable sleeve and an opening (17) in connection with the safety sleeve, the safety sleeve and the expandable sleeve defining a space (13) which is in fluid communication with the annulus through the opening, wherein the safety sleeve has a middle part (27) arranged between the two connections, and the opening is arranged closer to one of the connections than the middle part, enabling fluid communication between the space and the annulus opposite one of the connections through the opening.

2. An annular barrier according to claim 1, wherein the safety sleeve has an extension along the longitudinal axis of the tubular part which is less than 30% of an extension of the expandable sleeve along the longitudinal axis of the tubular part, preferably less than 20% of the extension of the expandable sleeve, more preferably less than 10% of the extension of the expandable sleeve.

3. An annular barrier according to claim 1, wherein the safety sleeve comprises a sleeve part (25) being fastened to the expandable sleeve by means of at least one of the second connections and having a thickness ($t_1$) which is less than a thickness ($t_2$) of the expandable sleeve.

4. An annular barrier according to claim 1, wherein the safety sleeve is made of a material having a lower E-modulus than that of the expandable sleeve.

5. An annular barrier according to claim 1, wherein a sealing element (18) is arranged on an outer face (19) of the safety sleeve.

6. An annular barrier according to claim 1, wherein the safety sleeve comprises a recess (20).

7. An annular barrier according to claim 6, wherein a sealing element (18) is arranged in the recess.

8. An annular barrier according to claim 1, wherein the opening is arranged between one of the connections and the recess.

9. An annular barrier according to claim 1, wherein the opening is arranged between one of the connections and the expandable sleeve.

10. An annular barrier according to claim 9, wherein the opening is provided as a groove in the one of the connections along the longitudinal axis of the tubular part.

11. An annular barrier according to claim 1, wherein the safety sleeve comprises a sleeve part (27) fastened to the expandable sleeve by means of at least one of the connections, and the opening is arranged between one of the connections and the sleeve part.

12. An annular barrier according to claim 1, wherein the safety sleeve comprises a sleeve part fastened to the expandable sleeve by means of at least one of the connections and a sheet (28) arranged between the sleeve part and the expandable sleeve and at least partly circumferencing the expandable sleeve.

13. An annular barrier according to claim 12, wherein the sheet partly circumferents the expandable sleeve, providing a channel (29) being the opening between the connection and the expandable sleeve.

14. An annular barrier according to claim 1, wherein the first and second connections are connection rings.

15. An annular barrier according to claim 14, wherein the annular barrier has a first end and a second end and the opening in a first safety sleeve positioned closest to the first end is arranged closer to the first end than the second end in relation to a middle part of the first safety sleeve, and the opening in a second safety sleeve positioned closest to the second end is arranged closer to the second end than the first end in relation to a middle part of the second safety sleeve.

16. An annular barrier according to claim 1, wherein the connections comprise projection elements (51) for anchoring the annular barrier along the longitudinal axis.

17. An annular barrier according to claim 16, wherein the projection element (51) is a spike, barb or similar projection, or a circumferential peaking projection.

18. An annular barrier according to claim 1, further comprising an anchoring section (50) comprising projection elements (50) arranged on the outer face of the expandable sleeve.

19. A downhole system comprising a well tubular structure and at least one annular barrier according to claim 1.

20. A seal maintaining method comprising the steps of:

inserting an annular barrier according to claim 1 in the borehole having a well pressure, expanding the expandable sleeve by injecting pressurised fluid into the aperture, and expanding the safety sleeve to force the sealing element into sealing contact with the wall of the borehole when the well pressure becomes higher than a predetermined pressure.

* * * * *